US005740046A

United States Patent [19]

Elestedt

[11] Patent Number: 5,740,046

[45] Date of Patent: Apr. 14, 1998

[54] METHOD TO CONTROL IN A TRACK TRAFFIC SYSTEM MOVING UNITS, DEVICE FOR EFFECTING OF SUCH CONTROL AND PROCESS FOR INSTALLATION OF THE DEVICE

[75] Inventor: Peter Elestedt, Göteborg, Sweden

[73] Assignee: ABB Daimler Benz Transportation Signal AB, Gothenburg, Sweden

[21] Appl. No.: 392,802

[22] PCT Filed: Aug. 31, 1993

[86] PCT No.: PCT/SE93/00713

§ 371 Date: Feb. 28, 1995

§ 102(e) Date: Feb. 28, 1995

[87] PCT Pub. No.: WO94/05536

PCT Pub. Date: Mar. 17, 1994

[30] Foreign Application Priority Data

Aug. 31, 1992 [SE] Sweden ..... 9202493

[51] Int. Cl.[6] ..... G08G 1/00; B61L 3/16

[52] U.S. Cl. ..... 364/436; 364/424.024; 342/457; 342/42; 340/991

[58] Field of Search ..... 364/436; 340/910, 340/944, 916, 991; 342/457, 42

[56] References Cited

U.S. PATENT DOCUMENTS

| | | | |
|---|---|---|---|
| 4,027,840 | 6/1977 | Blair | 364/436 |
| 4,093,161 | 6/1978 | Auer | 364/436 |
| 4,181,943 | 1/1980 | Mercer et al. | 364/426 |
| 4,247,897 | 1/1981 | McDonald et al. | 364/436 |
| 4,266,273 | 5/1981 | Dobler et al. | 364/436 |
| 4,305,556 | 12/1981 | Norton et al. | 364/436 |
| 4,361,301 | 11/1982 | Rush | 364/436 |
| 4,706,086 | 11/1987 | Panizza | 364/436 |
| 4,774,669 | 9/1988 | Schmitz et al. | 364/436 |
| 4,791,571 | 12/1988 | Takahashi et al. | 364/436 |
| 4,864,306 | 9/1989 | Wiita | 342/42 |
| 5,072,900 | 12/1991 | Malon | 246/5 |
| 5,126,941 | 6/1992 | Gurmu et al. | 364/436 |

FOREIGN PATENT DOCUMENTS

| | | |
|---|---|---|
| 1161940 | 8/1969 | United Kingdom . |
| 2140185 | 11/1984 | United Kingdom . |
| 8905255 | 6/1989 | WIPO . |

*Primary Examiner*—Kevin J. Teska
*Assistant Examiner*—Tyrone V. Walker
*Attorney, Agent, or Firm*—Lerner, David, Littenberg, Krumholz & Mentlik

[57] ABSTRACT

Method and device for control within a line network such as a tram line, of a number of rolling units in various line runnings, and a method for installation of said device. A number of passive position determination elements (9) such as transponders, arranged for radio scanning, are located at determined positions in the network. Control equipment (2) on board said rolling units is provided with devices (8) for scanning of the position determination elements (9) and with sensors (6) for measurement of distance travelled. The momentary unit position within the line network is determined by continuous measurement of distance travelled and by calibration of the thereby obtained position determination by scanning of successively passed position determination elements (9). Data on the design and topography of the line network is stored in a central equipment (1) and communication from the mobile units stating their positions is received in a data processing unit (4). The vehicle control is performed by transmission from the central equipment (1) to each mobile equipment (2) of control data, based on the individual position relative to that of other roling units, said control data comprising allowed minimum distance to the nearest other rolling unit.

15 Claims, 3 Drawing Sheets

METHOD TO CONTROL IN A TRACK TRAFFIC SYSTEM MOVING UNITS, DEVICE FOR EFFECTING OF SUCH CONTROL AND PROCESS FOR INSTALLATION OF THE DEVICE

TECHNICAL FIELD

The present invention relates to a method for controlling vehicles in a line network, a device for such vehicle control and a method of installing said device in a line network. The invention hereby primarily relates to line networks of the tramway type, which are characterized by an extensive network with a large number of branchings and crossings and in most cases by traffic together with other, not track-bound road-users. In such cases the line network is synonymous with a track installation, which however does not exclude the invention from being applied to other lines along which vehicles are intended to move in a bound motion, with the aid of, as alternatives to tracks, rails, steering girders, control cables, etc. The device thereby comprises devices within the line network in the shape of central, fixed units as well as mobile units on board the respective vehicles.

STATE OF THE ART

Control devices and control systems in line networks may have many duties. The original and most important one is to prevent collisions between vehicles moving in the network. For this purpose it is known since a long time ago to divide the line into zones and to prevent, by central control, any mobile unit from entering into a zone unless said zone is free from any other units. This system may be suitable for less dense traffic, such as railways. The system is however not suitable for use within tramway networks, where the traffic has to be dense and where the zones would thus have to be diminished into too short lengths, leading to major investment and control cost.

The Swedish patent No 334 912 (C. Jauquet) discloses such a division of the line into zones. Furthermore, a calculation of the movement within the zone by means of message to a central unit from the mobile unit about it's speed is suggested, making a distance calculation based on speed×time possible. Hereby, the speed may be centrally controlled if a collision risk occurs. By being able in this way to determine, at least approximately, the position within the zone of each unit, several units may be allowed into the same zone on the condition that the central surveillance unit as well as the communication with said unit functions. By this method of calculating the unit positions, the position determinations obtained are however so uncertain, that either the zones must be made very small, so that the calculation via the mobile unit may be updated frequently, or the number of allowed units within the same zone must be strictly limited. It should be added, that as the demand on traffic density for tramways is high, one would have to resort to the first mentioned alternative of very small zones, making it practically impossible to build such a system at a reasonable cost and with a reasonable control capacity.

The UK patent 2 140 185 (Reinhard Burger) also describes a division into zones and, within each zone, determination of movement by means of a rotation meter on the wheels of each vehicle. The position determination within the zone is then made centrally by emitting clock pulses which are returned by the vehicle with a delay corresponding to the distance of travel within the zone, measured by the rotation meter.

In both cases it is presumed that the passage by each vehicle of a zone borderline is reported to the central unit, whereupon information about speed and distance travelled is repeatedly transferred to the central unit. The latter will then calculates the location within the zone, and may, on the base of a corresponding calculation for any other mobile unit that might possibly be within the zone, control the velocity so as to avoid a collision if two units are approaching each other.

These systems thus require a physical division of the line network into zones, with installations that, when passed by by a mobile unit, trigger the central unit calculation of the distance travelled by means of a repeated exchange of information between the central unit and the mobile units. This causes a very frequent communication and should it for any reason break down during a period of time, the security of the position determination is lost. This indicates that cable-based signal transmission should be chosen for safety reasons. As the methods used for calculation of the distance travelled will necessarily produce a result having considerable tolerances, the zones must have a limited length unless the safety distances between the vehicles can be made very long.

The mentioned systems are primarily applicable to train traffic over longer distances on railway lines, as their traffic generally is not so frequent and the safety distances can be made long. This makes a division of the railway line into zones of considerable length, and thus of limited number, possible. For urban tramways the conditions are considerably more complicated as dense traffic as well as strongly varying speeds must be allowed. Under those conditions the zones would have to be very short in order for the tolerances of the calculated distance travelled within the zone not to risk the safety of the position determination.

DESCRIPTION OF THE INVENTION

The present invention is primarily intended for tramway applications, but other applications are of course not excluded in such cases where the invention may lead to advantages, e.g. by comprehensive and complex line networks and dense traffic.

By the present invention all division into zones is eliminated and there is thus no indication to a central unit of the passing of zone borderlines. Instead, the position within the line network of the own vehicle is calculated on board each vehicle by distance measurement during travel. In order for the position determination to be held within so close tolerances, that dense traffic may be allowed without safety risks, a calibration of said position determination is performed with short intervals by passive elements at determined fixed points, preferably by means of transponders scanned by radio equipment on board the vehicle. The determined position is transmitted by wireless communication to a central unit, which may thereby calculate the distance between different mobile units, for speed control and for any possible emergency braking. The position information may furthermore be used for general traffic control and survey.

FIGURE DESCRIPTION

In the following, a preferred embodiment of the invention is described, as well as it's control method, it's installation and the method of performing the installation. Hereby, reference is made to the following drawings, in which.

PREFERRED EMBODIMENT

Figure 1:
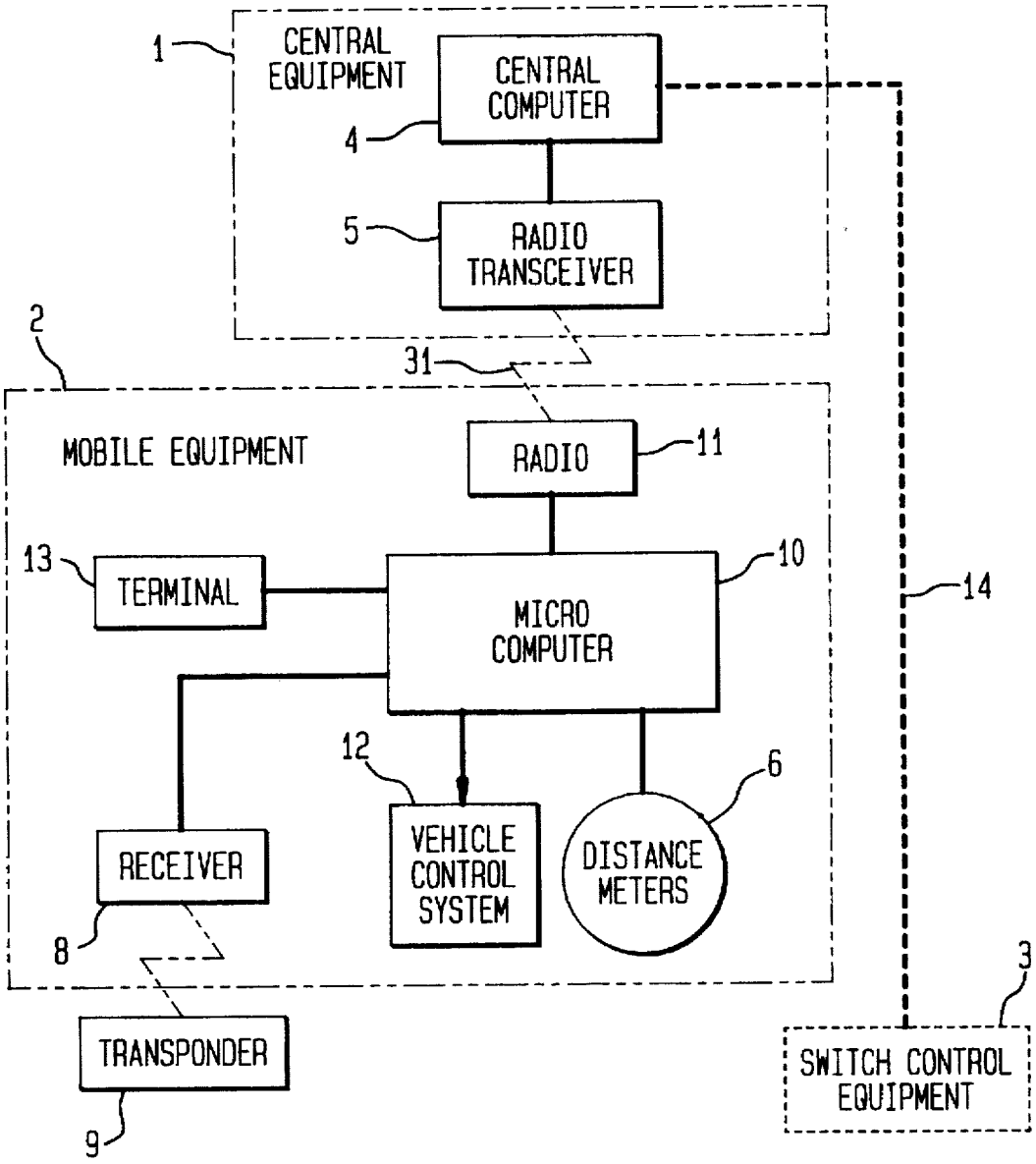
FIG. 1 shows a block diagram of an installation according to the invention.

FIG. 1 shows a block diagram of the principal parts of the control system and therein comprised main units. The principal parts are a central equipment 1, with a fixed location, and mobile equipment 2 on rolling units, carriages, in the system. Furthermore there is equipment for switch control 3 in the line network where the system is installed.

The central equipment 1 comprises a central computer system 4 and a communication radio transceiver 5. the central computer system contains a data base, where information about the track inclination, maximum allowed speed etc., are defined. This computer will receive by radio (see below), information about the position of every tram, and may thus assign an allowable travel distance, taking into consideration the other trams.

The mobile equipment 2 on board the carriages comprises distance meters 6. These include pulse counters mounted on the wheel axles, measuring distance covered. In this way the position and the speed of the carriage can be determined. In practice, at least two measuring wheels are necessary in order to detect slippage, blockage and any possible pulse counter function errors.

A distance meter only will unavoidably lead to an accumulated measurement error. The measured distance must therefore be adjusted when passing of a number of fixed points in the line network, preferably at every stop. This is done by a radio frequency sensor on board the carriage registering the passage of a passive transponder 9 placed in the ground between the tracks or suspended from the current supply line.

A micro computer 10 collects the data from the distance meter and the position updating sensor, receives and transmits data via a communication radio 11 (see below), controls the vehicle propulsion and braking systems via a unit 12 when needed, and handles communication with the driver.

A terminal 13 in the shape of a computer monitor or a panel, gives the driver access to relevant information from the micro computer. A set of buttons or similar allows the manual interventions into the system that may become necessary.

The carriages are in connection with the central equipment via the radio transceivers 5, 11 or another means allowing continuous communication. The central system is the master, demanding information from the carriages at the same time as the allowed travelling distance is transmitted. The carriages respond by transmitting their positions and status, especially their speed, their stops and train lengths, etc.

The passive transponders 9 within the network constitute the updating points and in the basic version of the system are the only installations needed outdoors in the network. The system efficiency may be improved by in addition installing the equipment 3 which signals the position of switches to the central equipment and allows control of the switch therefrom.

The carriage on-board equipment consists of, as stated in connection with the description of FIG. 1, a number of functional units connected by standardized interfaces. These main units have the same numbers in FIG. 2 as in FIG. 1. Every functional unit shall be easily replaceable and have an interface so specified as to allow the use of alternative equipment where available.

Figure 2:
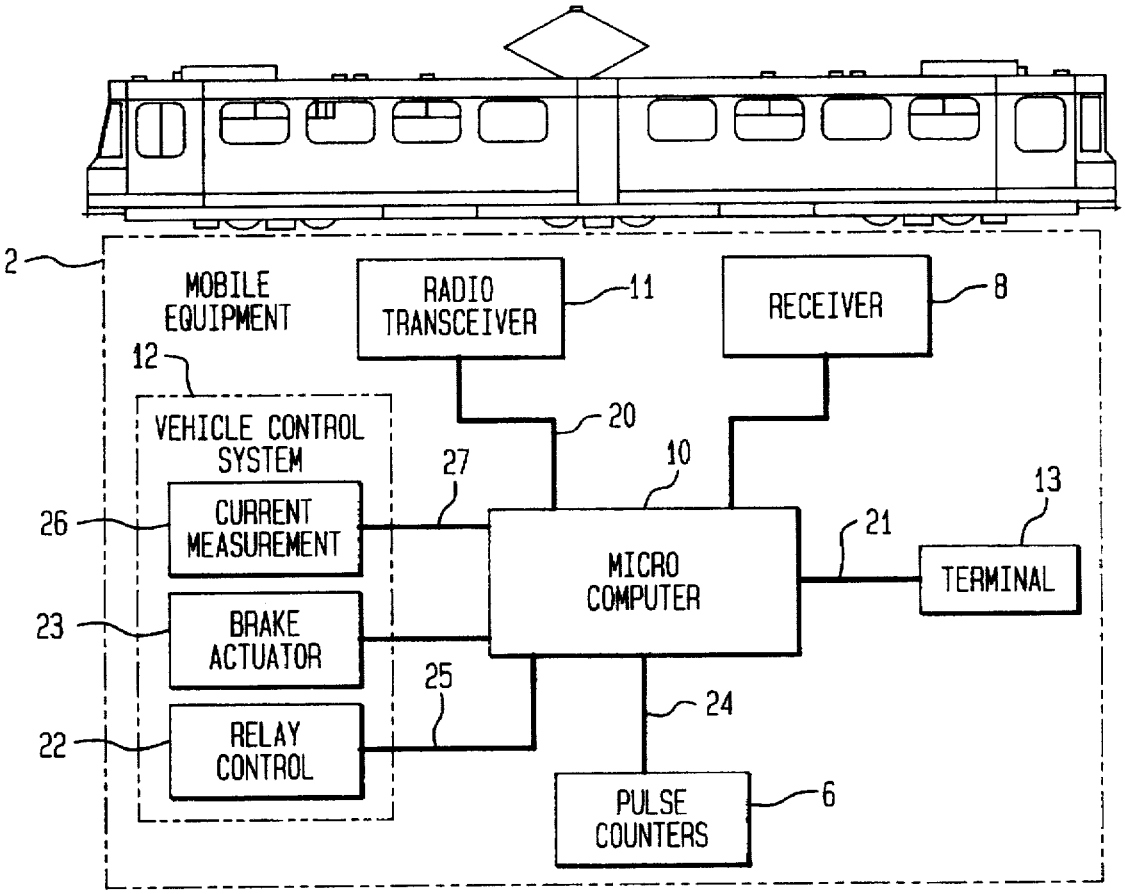
FIG. 2 shows a block diagram of equipment carried by the mobile units.

The computer unit 10 with it's adherent input and output units are connected to equipment as shown in the block diagram of FIG. 2.

The on-board equipment communicates with the stationary system through a data transfer interface 20 via the radio transceiver 11.

In order to determine it's absolute position, the control computer receives position identities from unit 8 which can read information from "beacons" (transponders 9 in FIG. 1) located in the line network.

In order to give information to, respectively get information from the driver, there is an equipment 13 by the driver's seat. Said equipment is connected with the control computer by one or more interfaces 21. The design of the equipment will decide the design of the interfaces.

As the train protection system intervenes in order to influence the carriage speed or the driver's possibility of motor actuation, it must have ability to influence the motor control, The unit 12 may for example consist of a relay control 22 that interrupts the possibility of motor actuation.

For measuring the distance between the updating points, all the tram carriage axles are equipped with pulse counters 6. The latter are connected to pulse counter inputs in the control computer via the interface 24. To be able to forcibly brake the tram car, the computer must be able to actuate the brakes. This connection 25 to unit 23 may be of the same type as the control for preventing motor actuation. For determination of the carriage inertial mass, the motor current at the respective motor is measured. The measuring units 26 located at the motor feed transmit their measurement values via 27 to the control computer for calculation of the mass.

An important goal by the invention is to considerably limit modifications to and new installations in the line network and especially to avoid division into zones of the kind mentioned by way of introduction, i.e. designed for signalling the passage of mobile units into and out of a zone, to a central installation. It is especially important to achieve this goal at tramway lines comprising a complex network and having a requirement for dense traffic with frequent speed changes and stops.

The means for achieving said goal is that the necessary position determination of the rolling units is primarily made by the on-board equipment of each rolling unit. Every rolling unit thus determines it's own position within the line network by means of it's distance meters and it's communication with the passive transponders 9 in the line network, which is not synonymous to the communication taking place when passing a zone border line in the mentioned known systems, but is used solely for calibration of the position determination, based on distance travelled, of the rolling unit.

To uphold in this way a position determination, generated and available in the rolling units, entails the advantage that the information about the position of the own unit within the line network can be maintained also in between the occasions when communication with the central equipment takes place. Thereby, the communication volume within the system may be reduced and on board the rolling units there will be a continuous information about their own position without information about this having to be collected from the central equipment. Both these effects are important, especially if wireless communication is used, where the communication capacity may be limited within the allotted channel range and where communication interruptions may occur partly through interference and partly by the fact that in certain locations, e.g. inside tunnels, no radio communication at all is possible without complicated arrangements. To be able to use wireless communication in the system is important where the traffic is extensive and the line network is complicated, which is particularly the case with urban tramways where there are few if any sections which are blocked for other traffic.

The main object of the present invention is to prevent collisions between the rolling units that are part of the system. In the first place this is to be carried out by information to the respective driver about the traffic situation, starting out from his own position and giving information about other units within the nearest area including the distance between units. If the driver does not uphold a certain security distance, the central system shall be able to engage automatic emergency braking. It is presupposed that the rolling units are operated by a driver, primarily relying on his own visual impressions and his knowledge of the line network and, as a supplement, information from the on-board equipment of his own rolling unit via said monitor or panel. This information, as stated before, is partly generated in the on-board equipment and partly obtained through information and orders from the central equipment. If the driver should go below the predetermined security distance, this, as mentioned, generates an emergency braking.

The length of the security distance as well as speed control in relation to a speed limit is established on the basis of various conditions within the line network and also of temporary circumstances, like the weather. Decisive conditions for safety distances and speed limits within the line network are the traffic environment; from sections with mixed traffic, via sections with trackbound traffic having different destinations, stopping points etc., to protected sections blocked for all other traffic except a certain line where all units have a similar driving schedule. Track inclination as well as the existence of switches, stops etc., where braking must be performed, are also such conditions. Temporary circumstances are, except for the weather, where e.g. rain may give rise to a lower speed limit and longer safety distances, also the existence of temporary works along the lines, traffic jams etc.

As stated, the system is based on a co-operation between the central equipment and the mobile equipment, using sophisticated data processing and data storage in both equipment types. The distribution of the data processing and the data storage between the two types of equipment may be formulated differently within the scope of the invention. The more advanced equipment used in the rolling units, the more the communication volume with the central installation may be reduced, and vice versa. The most advanced case concerning the mobile equipment is hereby that all conditions regarding the part of the line network to be operated are stored in the mobile equipment, and as the position of the rolling unit is changed, relevant information about the nearest driving distance is displayed for the driver's knowledge. The information about more or less permanent conditions now and then have to be completed from the central installation with information regarding more temporary conditions such as the weather and the traffic situation, which are also stored in order to control the driver information. Data to be more frequently transmitted from the central installation are the positions of other rolling units within the nearest area, coupled with information about their speeds, which information can be used for calculations in the on-board equipment of safety distance, recommended speed and upper speed limit, etc., with the own velocity plus the display of the above data regarding other rolling units within the nearest area as basic factors.

By an intermediate embodiment form, data for the whole line network to be run during a certain period of time are not stored, but only data for the nearest sections in front which are given as successive information to the driver along the passage of this distance, whereafter a new set of information is transferred from the central equipment. Hereby a smaller amount of information is stored in the mobile equipment but the communication volume increases somewhat, as well as the sensitivity to non-appearing information.

In the simplest version regarding the mobile equipment, almost all necessary data are stored in the central equipment and calculations of security distance and speed limit take place there, whereupon the information and control commands to be communicated are transmitted in smaller blocks with shorter intervals. Hereby, a relatively large communication volume is required and the sensitivity to non-appearing information becomes fairly high. This type of embodiment is thus not preferred for the system according to the invention.

By the first, most advanced version concerning mobile equipment, the communication can mainly be limited to transmissions from the central equipment of information about certain temporary conditions, which ought to be needed relatively seldom, and to a more frequent bi-directional communication with data from the mobile equipment about it's own position and speed, and information from the central equipment to each mobile equipment about the positions and speeds of other rolling units within a nearby area, e.g. units that might within a short period of time come within collision distance. Communication of speed shall of course also include direction of travel, and in the context it should be mentioned that in case of reversing rolling units, such information is exchanged that the security distance is directed into the assumed direction of travel. As mentioned, said basic information; momentary position and speed, may in the mobile equipment be used for determination of transfer within the nearest time span so that within a limited time, the rolling unit will be self-sufficient concerning the relative distance to nearby units and the variations thereof. Through such an arrangement, the frequency of the most frequent communication, that is the transmission of position and speed information, can be made lower. If on the other hand the calculation of the relative distance is being made in the central installation, the frequency of information must increase, the closer to each other the units are coming.

It has now been described above how the system according to the invention is laid out and how it may be varied within certain frames. In that connection, the primary effects of the system have been related, i.e. collision protection and preferably also speed limitation, based partly on position data and partly on information about other circumstances. However, the system is ideally suited for being given certain supplementary functions. Among more important such functions may be mentioned switch control, where the central equipment is responsible for change-over of at least certain switches within the line network for adaptation to the intended direction of travel of a rolling unit approaching said switch; traffic control e.g. for re-routing in case of congested traffic or other occurring obstacles, or for modified running schedules in dependence of the passenger influx, and traffic surveillance, whereby information is collected about delays, stoppages etc., so that relevant information and traffic control can be issued.

Through the described basic functions of the system, the risk of collision between track-bound vehicles, equipped to be covered by these basic functions, are completely eliminated. These basic functions may also be the platform for a number of supplementary functions needed for surveillance, control and modification of the train protection system.

As a basis for these functions, correct information about the position of each vehicle is mandatory. As this information regarding the rolling units is available in the system, an integration of the supplementary functions appears natural. Several of the supplementary functions described sketchily above (integration with traffic signals, correlation to time table) also intervene into the duties of the traffic information systems. A coordination can therefore considerably increase the efficiency of such functions, as not only all the vehicles, but also other public transports and emergency vehicles, can be considered.

The system also offers vast possibilities for the production of statistics, for planning as well as for maintenance follow-up (time of operation and distance travelled for each carriage, reported faults and stoppages, etc.) and for the over-all traffic planning and scheduling (delays, waiting times, queuing times etc.).

As a separate supplementary function, a simulation system may be produced, based on the same software as the train protection system. With the aid of such a system the consequences of e.g. schedule modifications can be studied during various operational conditions, before the changes are implemented.

As mentioned before the functions of the system are based partly on stored information about the condition of the line network. Among such information shall be data about track inclination, type of traffic environment (mixed traffic, multi-destination lines and protected sections), switch positions, stops and calibration points where the transponders are located. For generation of this information to be stored in the central equipment and, to a larger or smaller extent, in the mobile equipment, a measuring and registration vehicle is preferably equipped with sensors for the properties to be stored, e.g. track inclination, and an input terminal for not directly measurable conditions like stop locations, switch positions and transponder locations. In this way it is possible, by driving the vehicle through the various sections of the line network, to perform a complete registration of wanted information, which is related to measured travel distances and input fixed points. Said information may then be used during system operation in the previously described manner.

One possible function mode of the system can be expressed as the assignment of free running distance. A running distance in the direction of travel, where no obstacles exist or may occur, is then centrally calculated for each rolling unit. During the negotiation of this distance the driver may conduct the vehicle freely in accordance with his own judgement as long as the upper speed limit is not exceeded, in which case a mandatory speed limitation intervenes. Said limitation may either be activated from the central equipment or be programmed into the mobile equipment for activation when the registered speed of the rolling unit exceeds the speed limit programmed for the section in question. Below the speed limit there is a warning speed, the passing of which is indicated to the driver so that he can manually regulate the speed to the predetermined level already before a forced retardation sets in.

As the assigned sections are negotiated, new sections are successively assigned, the length of which are determined by said permanent conditions of the line network and by temporary circumstances including other vehicles. In case of an obstacle at which the assigned section must terminate, the section will run until such a distance from the obstacle, that the driver can control the passage of or the halting at the obstacle. At a calculated warning distance from the obstacle the driver is made aware that braking readiness must be observed, and should the actual distance run below the calculated security distance, forced retardation is activated. According to what has been said earlier, this process may either be momentarily controlled in detail by radio transmission from the central equipment, or alternatively and preferably by the measures being taken by the mobile equipment, on the basis of basic data for calculation of warning and safety distances as well as of the successive speed limits to be applied, that have been transmitted before activation takes place. If the latter process is applied the system will not be sensitive to interruptions of communication at the critical moment immediately before reaching an obstacle. There will thus be time for repeated occasions of communication, should this be necessary.

Certain duties which may be performed by the system are described below:

Determination of a warning speed for each train at each moment. This speed lies below the monitored speed limit in such a manner that the driver will normally be able to remedy an excessive speed before forced retardation intervenes.

Prevention of further accelleration, when the train speed exceeds the warning speed.

Activation of the various carriage braking and sanding systems in a suitable sequence when the train speed exceeds the monitored limit.

Activation to the full extent of the available carriage braking systems, when a security-critical failure of the train protection or braking system is detected.

Registration, by a printer and in a history file, of the occurrence of a forced retardation.

Prevention of releasing the brakes after a forced retardation, before the train has come to a complete stop.

The system is able to:

show the driver the distance to a braking point before an obstacle ahead, determined by the system on the basis of the prevailing speed (i.e. the point where the warning speed coincides with the present train speed);

alert the driver when the warning speed is exceeded;

give the driver the opportunity to also read the distance to the obstacle itself;

tell the driver if the obstacle ahead is a moving vehicle or a fixed obstacle;

give the driver the possibility to see the type of obstacle at hand. Possible alternatives:

tram moving in the same direction;

tram crossing the direction of travel of this carriage (by temporary single track traffic also oncoming tram);

switch area, blocked for other trams;

work vehicle;

decrease of the maximum permitted track speed (the new speed limit shall also be shown);

temporary blocking introduced through manual intervention, e.g. for maintenance work;

indicate, where appropriate, that the position of the obstacle ahead is unspecified (e.g. at re-introduction after failure), necessitating the application of an extra safety margin, and show the driver the permitted speed for the present line section.

Communication Equipment

For the constant communication between the central equipment and the equipment on board the rolling units a radio data link is used. Compare the units 5, 11 in FIGS. 1, 2. The radio and the adherent modem comprise a separate functional block being connected to the control equipment via e.g. serial interfaces.

Figure 3:
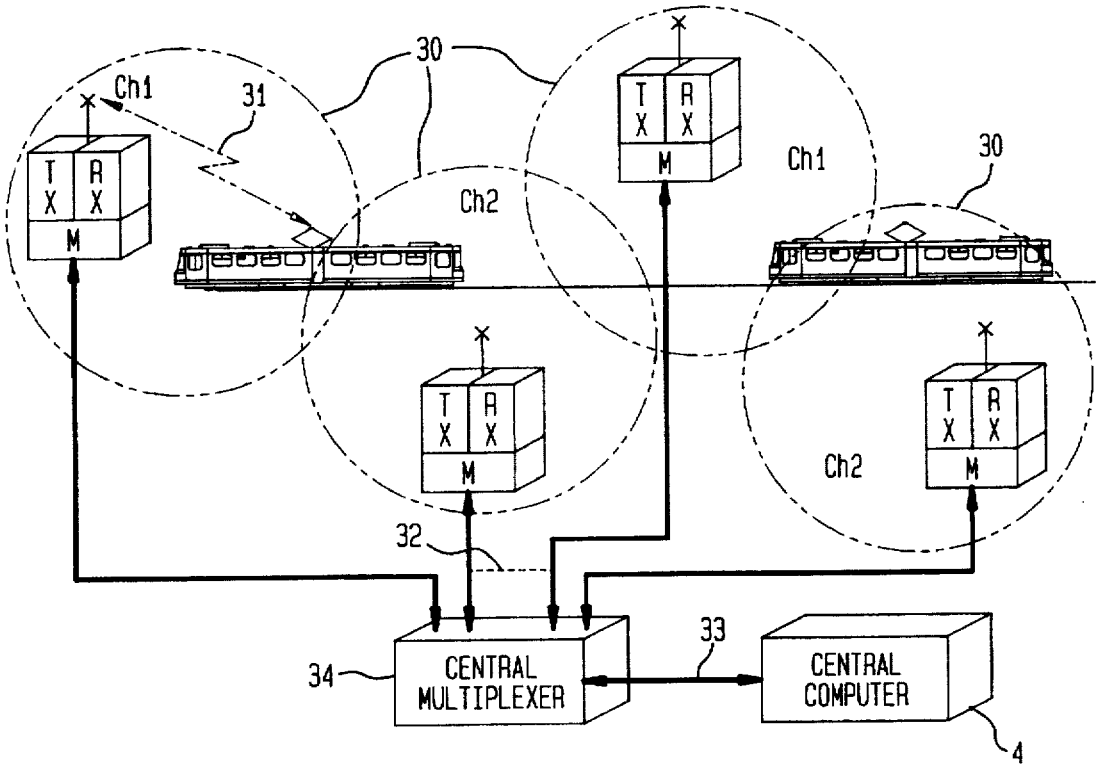
FIG. 3 shows schematically a stationary radio system for an installation according to the invention.

In order to be able to reach all units in the complete line network and at the same time to obtain acceptable response times, the line network may be divided into communication cells 30 (see FIG. 3). Full coverage with overlap is obtained by a two-channel cell system. Within each cell, the tram communicates on a frequency which does not affect the communication in adjacent cells. In a communication link 31 the central system communicates with the carriages via a radio protocol. In order to assure the system response times, the highest possible transmission speed should be aimed at. Between the distributed radio/modem stations and a central multiplexer 34 the communication 32 is performed via a line protocol. The central unit communicates with the multiplexer unit via a high speed transmission 33. The duty of the multiplexer unit is to distribute the communication to the units so that a message is sent only to that cell where the receiver of said message is located. Received messages are collected and retransmitted to the central unit for further processing.

By duplicating the radio part of the communication equipment on board the carriage, the intelligent modem can handle the communication between the mobile and the stationary system at the same time as it, via the other radio, searches for better signal conditions. In this way a constant checking of of the radio equipment function is obtained simultaneously. By equipping the tram with duplicated equipment, the availability is increased at the same time as the "spare" radio may be used for continuous searching for the link offering the safest transmission.

I claim:

1. A method for controlling a plurality of mobile units in a network comprising a central control unit, a plurality of mobile control units each associated with one of said plurality of mobile units, and a plurality of passive position determining members located throughout said network, said method comprising storing data relative to the positions of said plurality of passive position determining members within said network in each of said plurality of mobile control units, scanning said passive position determining members whereby the position of said plurality of mobile units within said network can be determined, sensing the distance traversed by said plurality of mobile units within said network, whereby each of said plurality of mobile control units can continuously determine the momentary position of each of said plurality of mobile units within said network, storing said momentary positions of said plurality of mobile units within said mobile control units, storing data relating to the nature of said network in said central control unit, communicating between said mobile control units and said central control unit for generating control data for controlling each of said plurality of mobile units within said network, said control data being communicated from said central control unit to said plurality of mobile control units including the assignment of a free running distance based upon an allowable minimum distance to a predetermined point in said network, maintaining said free running distance on each of said plurality of mobile units, and forcing the retardation of said mobile units based upon said free running distance being reached.

2. The method of claim 1 wherein said control data being communicated from said central control unit to said plurality of mobile control units includes a warning distance, a minimum distance, a warning speed, and a maximum speed, and includes providing advice to a driver for each of said plurality of mobile units when said warning distance or said warning speed has been reached.

3. The method of claim 2 including automatically causing said plurality of mobile units to retard its speed when said minimum distance or said maximum speed has been reached.

4. The method of claim 1 including continuously determining the momentary speed of each of said plurality of mobile units, said control data including upper speed limits for each of said plurality of mobile units.

5. The method of claim 1 including storing communications from said central control unit in said plurality of mobile control units and processing said stored information between communications between said mobile control units and said central control unit.

6. Apparatus for controlling a plurality of mobile units in a network comprising a central control unit, a plurality of mobile control units each associated with one of said plurality of mobile units, a plurality of passive position determining members located throughout said network, each of said plurality of mobile control units including first data storage means for storing data relative to the positions of said plurality of passive position determining members within said network, scanning means for scanning said passive position determining members whereby the position of said plurality of mobile units within said network can be determined, a plurality of sensor members for sensing the distance traversed by said plurality of mobile units within said network, whereby each of said plurality of mobile control units can continuously determine the momentary position of each of said plurality of mobile units within said network, means for storing said momentary positions of said plurality of mobile units within said mobile control units, said central control unit including second data storage means for storing data relating to the nature of said network, communication means for communicating between said mobile control units and said central control unit for generating control data for controlling each of said plurality of mobile units within said network, said control data including an assignment of a free running distance based upon an allowable minimum distance to a predetermined point in said network, and means for forcing the retardation of said mobile units based upon said free running distance being reached.

7. The apparatus of claim 6 wherein said control data being communicated from said central control unit to said plurality of mobile control units includes a warning distance, a minimum distance, a warning speed, and a maximum speed, and includes providing advice to a driver for each of said plurality of mobile units when said warning distance or said warning speed has been reached.

8. The apparatus of claim 7 including automatically causing said plurality of mobile units to retard its speed when said minimum distance or said maximum speed has been reached.

9. The apparatus of claim 7 wherein said network comprises a tram line and wherein said plurality of mobile units comprises a plurality of rolling tram units.

10. The apparatus of claim 6 wherein said position determining members comprise transponder means.

11. The apparatus of claim 6 wherein each of said plurality of mobile units includes unit control means for controlling parameters relating to the position of said plurality of mobile units within said network, whereby said communication means can activate said unit control means.

12. The apparatus of claim 6 wherein each of said plurality of mobile control units can continuously determine the momentary speed of each of said plurality of mobile units, and wherein said control data includes upper speed limits for each of said plurality of mobile units.

13. The apparatus of claim 6 wherein said first data storage means includes first data processing means whereby said communications from said central control unit can be stored and processed within said first data storage means between communications from said communications means.

14. The apparatus of claim 6 wherein said communications means successively transmits portions of said data from said second data storage means to said mobile control units, wherein said data is stored in said first storage means to be provided to a driver for said plurality of mobile units whereby he can manually control said mobile units.

15. The apparatus of claim 14 wherein said control data communicated from said second data storage means includes data concerning temporary conditions within said network.

* * * * *